United States Patent [19]

Rozmus

[11] 4,447,390

[45] May 8, 1984

[54] METHOD FOR HOT-CONSOLIDATING POWDER USING STAGED TEMPERATURE AND PRESSURE CAUSING COMPACTION FROM THE OUTSIDE INWARD

[75] Inventor: Walter J. Rozmus, Traverse City, Mich.

[73] Assignee: Kelsey Hayes Company, Romulus, Mich.

[21] Appl. No.: 315,025

[22] Filed: Oct. 26, 1981

[51] Int. Cl.[3] ..... B22F 3/14; F27D 7/00

[52] U.S. Cl. ..... 419/49; 419/54; 264/64; 264/65; 264/66; 264/325; 264/332

[58] Field of Search ..... 75/226; 264/375, 332, 264/111, 64, 65, 66; 419/54, 49, 68

[56] References Cited

U.S. PATENT DOCUMENTS

| | | | |
|---|---|---|---|
| 4,023,966 | 5/1977 | Loersch et al. | 264/332 |
| 4,112,143 | 9/1978 | Adlerborn et al. | 264/332 |
| 4,256,688 | 3/1981 | Adlerborn et al. | 264/325 |
| 4,359,336 | 10/1982 | Bowles | 419/49 |

FOREIGN PATENT DOCUMENTS

| | | | |
|---|---|---|---|
| 659285 | 4/1979 | U.S.S.R. | 75/226 |

*Primary Examiner*—Benjamin R. Padgett
*Assistant Examiner*—Matthew A. Thexton
*Attorney, Agent, or Firm*—Harold Milton, Jr.

[57] ABSTRACT

A method for hot-consolidating powder of metallic and nonmetallic composition and combinations thereof to form a densified compact at a predetermined temperature and pressure at which the powder is transformed into a compact comprises the steps of filling the cavity of a container with a powder, such as a superalloy, to be compacted and hermetically sealing the container. The method is characterized by the steps of heating the container within an autoclave having an inert gas therein, such as argon, to an intermediate temperature, then pressurizing the autoclave to an intermediate temperature and thereafter raising the temperature to thereby increase the pressure and, consequently, reach the temperature and pressure to effect compaction or densification of the compact or article.

4 Claims, No Drawings

METHOD FOR HOT-CONSOLIDATING POWDER USING STAGED TEMPERATURE AND PRESSURE CAUSING COMPACTION FROM THE OUTSIDE INWARD

TECHNICAL FIELD

This invention relates to a method for consolidating a powder of metallic and nonmetallic composition and combinations thereof to form a densified compact. The method is particularly suited for consolidating the powder in a sealed container within an autoclave.

Generally, an autoclave is used to exert a combination of temperature and pressure upon the container enclosing powder to be compacted. At a combination of a predetermined temperature and pressure, the powder is consolidated into a compact.

BACKGROUND ART

Prior art methods for consolidating a powder, such as nickel, titanium, or cobalt-base superalloys, generally consist of the steps of filling a thin-walled container with the powder, placing the container in an autoclave, raising the temperature of the autoclave to a predetermined temperature, and then raising the pressure to a predetermined pressure to cause compaction. During this process, the powder is first subjected to a high temperature and then the pressure is raised to the predetermined pressure at which the powder will become a compact, the raising of the pressure requiring a long time period.

Problems can be experienced using this prior method. First, the container in which the powder is compacted may have a shape such that, as the pressure is applied to the already heated container and powder, certain areas of the container may move inwardly prior to other areas thereby resulting in a compact of a shape which is other than the desired final shape. In other words, when first heating the container to the temperature necessary for compaction and they applying pressure to the container, it is frequently impossible to obtain the desired shape because of the uneven inward movement of the various portions of the container surrounding the powder. Secondly, when the powder is at the high compaction temperature for the very long time required to raise the pressure to that required for compaction, there is time for dissolved carbon to be diffused to the surfaces of the powder particles. This results in undesirable boundaries between the particles in the densified compact or article.

An example of a prior art process is disclosed in the U.S. Pat. No. 3,954,419 to Kaufman et al, granted on May 4, 1976. The Kaufman et al patent discloses a cycle for compacting powder metal under heat and pressure by first heating the powder metal in a graphite die to about 1900° to 2100° F. then applying a pressure of about 2700 to 3300 psi, followed by heating the material to about 2600° to 2700° F. while the pressure is maintained constant. In other words, the container or die is heated to a high intermediate initial temperature, a pressure is exerted on the powder within the container, and then the container is further heated to a temperature while the initial pressure is maintained.

STATEMENT OF INVENTION

The subject invention relates to a method for hot-consolidating powder of metallic and nonmetallic composition and combinations thereof to form a densified compact at a predetermined temperature and pressure at which the powder is transformed into a compact. The method comprises the steps of filling the cavity of a container with a powder to be compacted an hermetically sealing the container. The method is characterized by the steps of heating the container within a sealed chamber having gas therein to thereby raise the pressure as the temperature increases to reach the predetermined temperature and pressue which will cause compaction of the powder.

In accordance with the subject invention, the container is not kept at a high temperature for a long period of time prior to the compaction of the powder enclosed therein. Hence, the subject invention provides a method by which the container moves inwardly evenly to produce a compact having the desired shape. Furthermore, the amount of the time at which the container is kept at a high temperature is greatly reduced, thereby decreasing the amount of diffusion of the dissolved carbon.

DETAILED DESCRIPTION OF THE INVENTION

A method for consolidating powder of metallic and nonmetallic composition and combinations thereof to form a densified compact at a predetermined temperature and pressure at which the powder is transformed into a compact is provided by the instant invention.

Initially, the cavity of the container is filled with a powder to be compacted. A thin-walled container of the type disclosed in U.S. Pat. No. 3,622,313, granted Nov. 23, 1971 may be used. An example of a container would be a cylindrical container made from a material such as stainless steel. Examples of powders used are superalloys containing cobalt or titanium. These superalloys may or may not be strain-energized. The superalloy is normally compacted at temperatures between 1850° and 2200° F. and a pressure of about 15,000 psi. Such pressures are attained in commercially available autoclaves.

After the container is filled with the powder to be compacted, the opening through which the filling was accomplished is hermetically sealed. This step is generally done by pinching the opening closed and welding it. The container is then placed in an argon gas autoclave. Although argon gas is generally used within the autoclave, other gases can be used instead of the argon.

The instant method is characterized by the step of heating the container within the autoclave having the argon gas therein to thereby raise the pressure within the autoclve as the temperature increases to reach the predetermined temperature and pressure which will cause compaction of the powder. In contradistinction to prior art methods, the powder to be compacted is not kept at a high temperature while the pressure within the autoclave is raised to the pressure necessary for compaction. In accordance with the instant invention, the temperature within the autoclave is raised, thereby raising the pressure within the autoclave so as to reach the predetermined temperature for compaction about the same time the predetermined pressure for compaction is reached. In other words, the increase in temperature within the autoclave occurs with a simultaneous increase in pressure. A predetermined temperature is chosen so that as the temperature within the autoclave is raised to the predetermined temperature, the pressure within the autoclave reaches the predetermined pressure for compaction. The result is that, as the predetermined temperature is reached, the powder within the container is compacted.

The powder compacts from the outside to the inside as the outermost powder experiences the predetermined temperature before the innermost powder. Additionally, as the powder reaches the predetermined temperature for compaction, it is also subjected to the predetermined pressure for compaction and compaction occurs as the powder reaches the predetermined temperature. Hence, as the article compacts from the outside to the inside, the innermost powder within the container is not subjected to the high compaction temperatures until the pressure for compaction is reached and, accordingly, diffusion of the dissolved carbon and other undesirables is significantly reduced.

Preferably, the container is heated within the autoclave to raise the pressure within the autoclave to the predetermined pressure for compaction prior to reaching the predetermined temperature which causes compaction of the powder. Thusly, it is insured that the powder will not incubate at the high compaction temperature prior to the autoclave reaching the predetermined pressure for compaction.

When an autoclave is used for repeated compactions, it is economically preferable to not bring the autoclave to room temperature prior to each run. In such a case, the container containing the powder may be placed in an autoclave which is initially heated to an intermediate temperature prior to raising the temperature and pressure within the autoclave to the predetermined temperature and pressure to cause compaction of the powder. Additionally, the pressure within the autoclave may be raised to an intermediate pressure prior to heating the container to raise the temperature and pressure to the predetermined temperature and pressure for compaction of the powder. Preferably, the autoclave pressure is first raised to a pressure which is approximately one-half ($\frac{1}{2}$) the predetermined pressure for the compaction.

A typical procedure for compacting powder using the instant invention includes the following steps. A container containing a strain-energized superalloy powder is placed in an autoclave containing argon gas. The container is initially heated to about 500° F. and the pressue within the autoclave is initially raised to 8000 psi. The temperature within the autoclave is then raised to about 1875° F. thereby expanding the argon gas to raise the pressure within the sealed chamber to approximately 15,000 psi, resulting in compaction of the article.

A second example of the subject invention includes the following steps. A container containing a nonstrain energized superalloy powder is placed in an autoclave containing argon gas. The container is initially heated to about 500° F. and the temperature within the autoclave is raised to about 8000 psi. The container is then heated to a temperature of about 2100° F. thereby expanding the gas and raising the pressure within the autoclave to approximately 15,000 psi resulting in compaction of the powder.

The invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein, yet remain within the scope of the appended claims.

The embodiments of the invention in which an exclusive property or privilege is claimed are defined as follows:

1. A method for hot consolidating powder of metallic and nonmetallic compositions and combinations thereof to form a densified compact at a predetermined temperature and pressure at which the powder is transformed into a compact, said method comprising the steps of: filling the cavity of a container with a powder to be compacted, hermetically sealing the container, subjecting the container to an intermediate gas pressure by inclusion of a predetermined amount of gas in a sealed container and sealing the container against gas flow into and out of the container to maintain the predetermined amount of gas within the sealed chamber, heating the container and the gas sealed within the chamber to raise the pressure of the gas within the sealed chamber in response to the increase of temperature thereof to reach the predetermined temperature and the predetermined pressure solely by the addition of heat to cause compaction of the powder from the outside to the inside as the outermost powder reaches the predetermined temperature and predetermined pressure for compaction before the innermost powder so that the compaction pressure is reached solely as a function of the heat input.

2. A method as set forth in claim 1 further characterized by heating the container within the sealed chamber having gas therein to raise the pressure therein to the predetermined pressure prior to reaching the predetermined temperature as the predetermined pressure is maintained to cause compaction of the powder.

3. A method as set forth in claim 2 further characterized by initially heating the container to an intermediate temperature, then raising the pressure within the sealed chamber to the intermediate pressure and then raising the temperature within the sealed chamber to increase the pressure to thereby reach the predetermined temperature and pressure to cause compaction of the powder.

4. A method as set forth in claim 2 further characterized by placing the container containing a superalloy powder into an autoclave containing argon gas, initially heating the container to about 500° F., raising the pressure within the autoclave to about 8000 psi, and then heating the container to a temperature of about 1875° to 2100° F. to raise the pressure within the sealed chamber to approximately 15,000 psi.

* * * * *